US005454342A

United States Patent [19]

Colquett et al.

[11] Patent Number: 5,454,342

[45] Date of Patent: Oct. 3, 1995

[54] DEVICES FOR CARRYING EQUIPMENT IN THE REAR OF A BOAT ADJACENT TO AN OUTBOARD MOTOR

[76] Inventors: Myron K. Colquett, P.O. Box 6, Opp, Ala. 36467; Gerald L. Burchfield, Rte. 2 Box 184 Woodham Rd., Opp, Ala. 36487

[21] Appl. No.: 249,708

[22] Filed: May 26, 1994

[51] Int. Cl.[6] ..... B63B 17/00

[52] U.S. Cl. ..... 114/364

[58] Field of Search ..... 114/343, 364; 224/273, 42.32, 42.43

[56] References Cited

U.S. PATENT DOCUMENTS

| | | | |
|---|---|---|---|
| 3,628,204 | 12/1971 | Hoffman | 114/343 |
| 3,805,722 | 4/1974 | Melchert et al. | 114/343 |
| 4,085,473 | 4/1978 | Franklin | 114/364 |
| 4,372,243 | 2/1983 | Roope | 114/343 |
| 4,495,883 | 1/1985 | Hoy | 114/364 |

*Primary Examiner*—Stephen Avila

[57] ABSTRACT

A device for carrying equipment in the rear of a boat adjacent to an outboard motor comprising a tubular frame of a rigid material, the frame having an upper rectangular component and a lower rectangular component, the rectangular components being disposed in spaced horizontal planes with parallel long sides and parallel short sides. The device further includes vertical posts coupling the corners of the upper and lower rectangular components and extending downwardly to form extensions terminating at the lower ends for being supported at the rear end of a boat. The device further includes two intermediate posts extending vertically at symmetrically spaced locations along both the forward and rearward edges of the frame. The device further includes additional tubing coupled with the lower rectangular component extending parallel with the short sides from the front to rear long sides. The device further includes a floor of expanded metal material secured around its periphery to the upper surface of the lower rectangular component and with a small rectangular opening

3 Claims, 3 Drawing Sheets

FIG 1
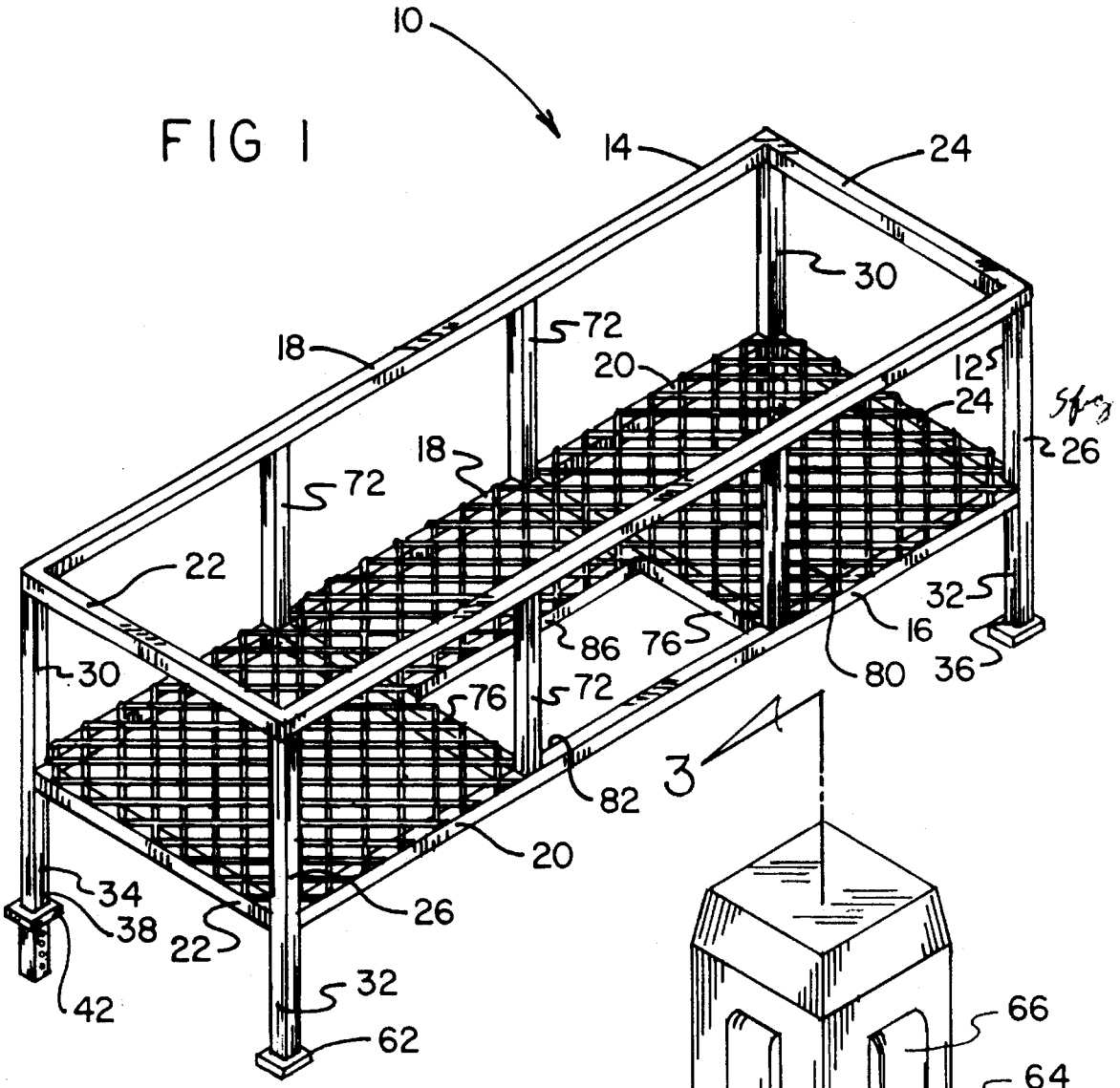
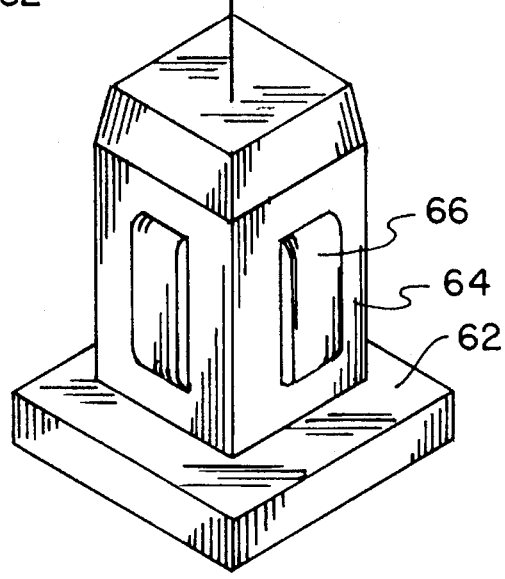
FIG 2

DEVICES FOR CARRYING EQUIPMENT IN THE REAR OF A BOAT ADJACENT TO AN OUTBOARD MOTOR centrally disposed therethrough adjacent to one end thereof to allow positioning of components of an outboard motor thereadjacent and with a horizontal support midway between the front and rear long sides of the lower rectangle for supporting the interior section of the floor.

BACKGROUND OF THE INVENTION

1. Field of the Invention

The present invention relates to a device for carrying equipment in the rear of a boat adjacent to an outboard motor and more particularly pertains to carrying equipment adjacent the rear of a boat with an outboard motor and with leveling capabilities.

2. Description of the Prior Art

The use of devices for carrying and storing various types of equipment and the like is known in the prior art. More specifically, devices for carrying and storing various types of equipment and the like heretofore devised and utilized for the purpose of storing and carrying a wide variety of devices in a wide variety of vehicles are known to consist basically of familiar, expected, and obvious structural configurations, notwithstanding the myriad of designs encompassed by the crowded prior art which has been developed for the fulfillment of countless objectives and requirements.

By way of example, the prior art discloses in U.S. Pat. No. 4,442,787 a boat platform having outboard and inboard positions.

U.S. Pat. No. 4,827,864 discloses a removable casting deck/storage locker for a bass boat.

U.S. Pat. No. 5,048,447 discloses a tournament style tackle box affixed to boat.

U.S. Pat. No. 5,092,263 discloses a boat utility platform and mounting clamp therefor.

Lastly, U.S. Patent Des. 270,828 discloses the design of a boat platform.

In this respect, the device for carrying equipment in the rear of a boat adjacent to an outboard motor according to the present invention substantially departs from the conventional concepts and designs of the prior art, and in doing so provides an apparatus primarily developed for the purpose of carrying equipment adjacent the rear of a boat with an outboard motor and with leveling capabilities.

Therefore, it can be appreciated that there exists a continuing need for a new and improved device for carrying equipment in the rear of a boat adjacent to an outboard motor which can be used for carrying equipment adjacent the rear of a boat with an outboard motor and with leveling capabilities. In this regard, the present invention substantially fulfills this need.

SUMMARY OF THE INVENTION

In view of the foregoing disadvantages inherent in the known types of devices for carrying and storing various types of equipment and the like now present in the prior art, the present invention provides an improved device for carrying equipment in the rear of a boat adjacent to an outboard motor. As such, the general purpose of the present invention, which will be described subsequently in greater detail, is to provide a new and improved device for carrying equipment in the rear of a boat adjacent to an outboard motor and method which has all the advantages of the prior art and none of the disadvantages.

To attain this, the present invention essentially comprises a device for carrying equipment in the rear of a boat adjacent to an outboard motor comprising, in combination, a tubular frame of a rigid material, the frame having an upper rectangular component and a lower rectangular component, the rectangular components being disposed in spaced horizontal planes with parallel long sides and parallel short sides. The device further includes vertical posts coupling the corners of the upper and lower rectangular components and extending downwardly to form extensions terminating at the lower ends for being supported at the rear end of a boat. The device further includes the two rearward legs at opposite ends of one long side being provided with an enlarged foot and an upwardly extending member with resilient surfaces for being press fit into the lower ends of the extensions for coupling therebetween and downwardly extending projections with parallel apertures therethrough for coupling with a mating tube with an aperture therethrough. The device further includes the two forward legs at opposite ends of one long side being provided with an enlarged foot and an upwardly extending member with resilient surfaces for being press fit into the lower ends of the extensions for coupling therebetween. The device further includes a pin positionable through each aperture of the mating tubes and a preselected aperture of the extensions. The device further includes two intermediate posts extending vertically at symmetrically spaced locations along both the forward and rearward edges of the frame. The device further includes additional tubing coupled with the lower rectangular component extending parallel with the short sides from the front to rear long sides. The device further includes a floor of expanded metal material secured around its periphery to the upper surface of the lower rectangular component and with a small rectangular opening centrally disposed therethrough adjacent to one end thereof to allow positioning of components of an outboard motor thereadjacent and with a horizontal support midway between the front and rear long sides of the lower rectangle for supporting the interior section of the floor.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent of legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved device for carrying equipment in the rear of a boat adjacent to an outboard motor which has all the advantages of the prior art devices for carrying and storing various types of equipment and the like and none of the disadvantages.

It is another object of the present invention to provide a new and improved device for carrying equipment in the rear of a boat adjacent to an outboard motor which may be easily and efficiently manufactured and marketed.

It is further object of the present invention to provide a new and improved device for carrying equipment in the rear of a boat adjacent to an outboard motor which is of durable and reliable constructions.

An even further object of the present invention is to provide a new and improved device for carrying equipment in the rear of a boat adjacent to an outboard motor which is susceptible of a low cost of manufacture with regard to both materials and labor, and which accordingly is then susceptible of low prices of sale to the consuming public, thereby making such device for carrying equipment in the rear of a boat adjacent to an outboard motor economically available to the buying public.

Still yet another object of the present invention is to provide a new and improved device for carrying equipment in the rear of a boat adjacent to an outboard motor which provides in the apparatuses and methods of the prior art some of the advantages thereof, while simultaneously overcoming some of the disadvantages normally associated therewith.

Still another object of the present invention is to carry equipment adjacent the rear of a boat with an outboard motor and with leveling capabilities.

Lastly, it is an object of the present invention to provide a new and improved device for carrying equipment in the rear of a boat adjacent to an outboard motor comprising a tubular frame of a rigid material, the frame having an upper rectangular component and a lower rectangular component, the rectangular components being disposed in spaced horizontal planes with parallel long sides and parallel short sides. The device further includes vertical posts coupling the corners of the upper and lower rectangular components and extending downwardly to form extensions terminating at the lower ends for being supported at the rear end of a boat. The device further includes two intermediate posts extending vertically at symmetrically spaced locations along both the forward and rearward edges of the frame. The device further includes additional tubing coupled with the lower rectangular component extending parallel with the short sides from the front to rear long sides. The device further includes a floor of expanded metal material secured around .its periphery to the upper surface of the lower rectangular component and with a small rectangular opening centrally disposed therethrough adjacent to one end thereof to allow positioning of components of an outboard motor thereadjacent and with a horizontal support midway between the front and rear long sides of the lower rectangle for supporting the interior section of the floor.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a perspective view of the new and improved preferred embodiment of the device for carrying equipment in the rear of a boat adjacent to an outboard motor constructed in accordance with the principles of the present invention.

FIG. 2 is a perspective view of the lower portion of one of the legs.

The same reference numerals refer to the same parts through the various Figures.

DESCRIPTION OF THE PREFERRED EMBODIMENT

Figures 3, 4:
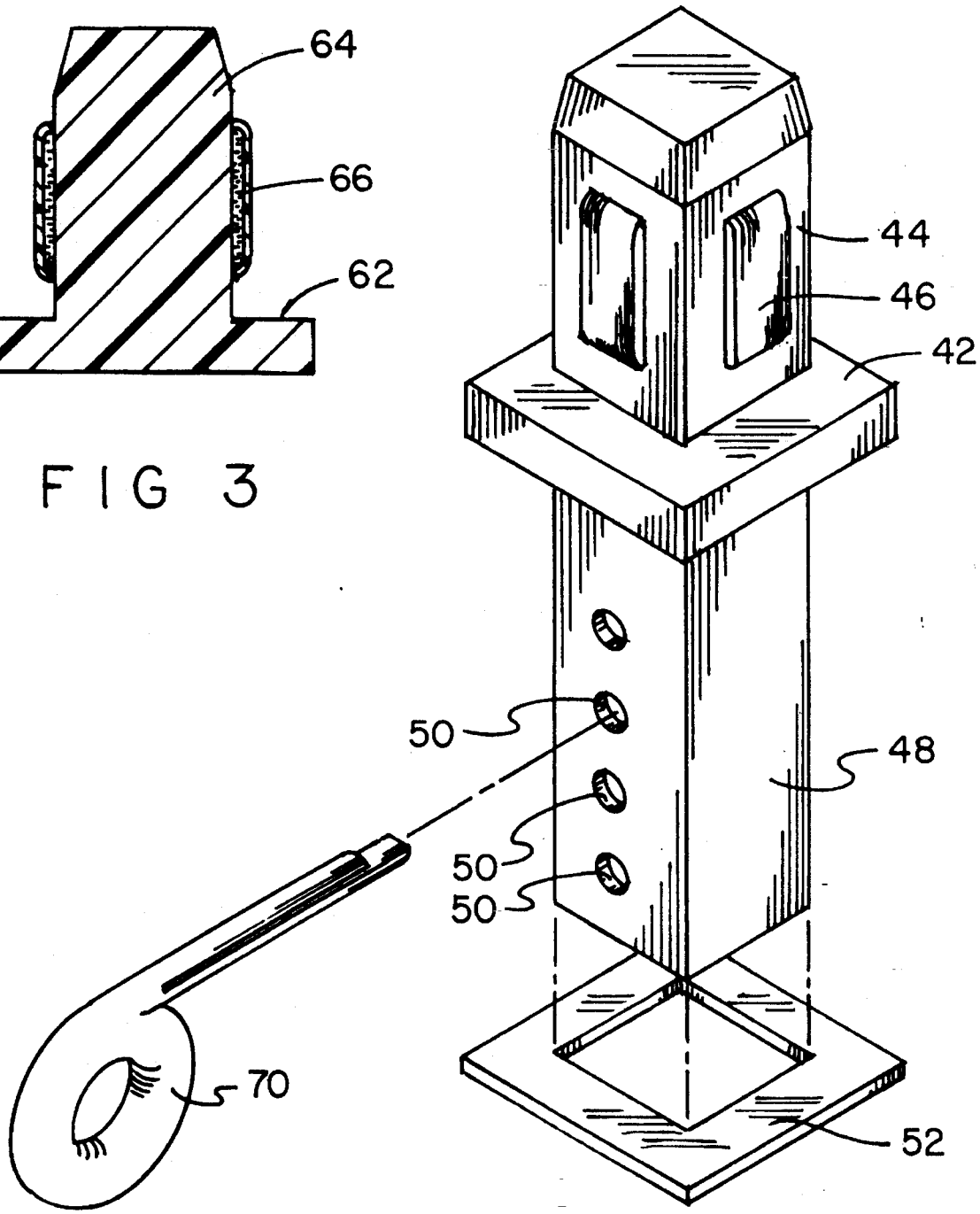
FIG. 3 is a cross-sectional view taken along line 3—3 of FIG. 2.
FIG. 4 is an exploded perspective view of one of the adjustable legs shown in FIG. 1.
Figure 5:
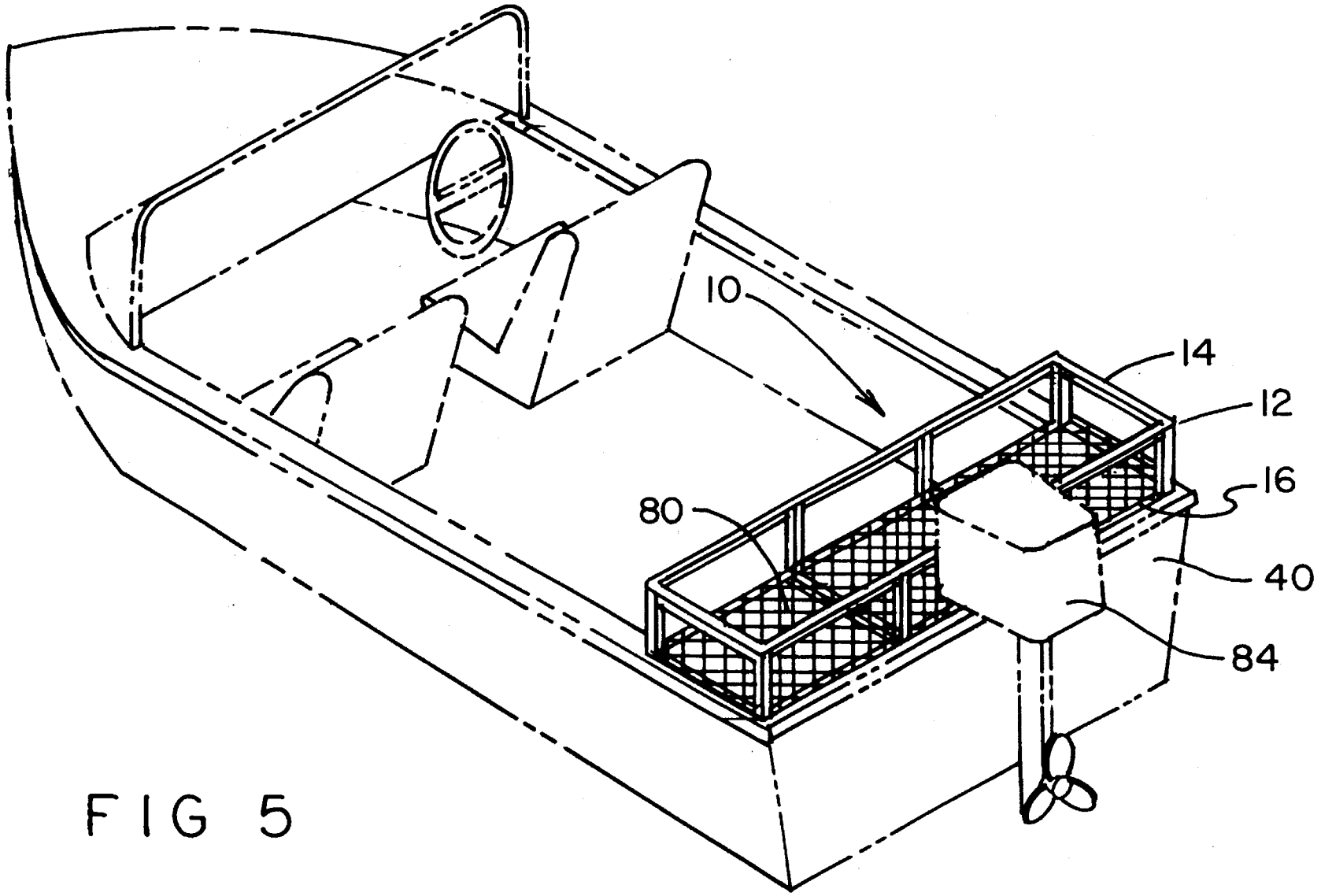
FIG. 5 is a perspective illustration of the device of Figure shown mounted in the rear of a boat.

With reference now to the drawings, and in particular to FIG. 1 thereof, the preferred embodiment of the new and improved device for carrying equipment in the rear of a boat adjacent to an outboard motor embodying the principles and concepts of the present invention and generally designated by the reference numeral 10 will be described.

The present invention, the new and improved device for carrying equipment in the rear of a boat adjacent to an outboard motor, is comprised of a plurality of components. In their broadest context, such components include a tubular frame, vertical posts, rearward legs, forward legs, a pin, intermediate posts, additional tubing and a floor.

Such components are specifically configured and correlated with respect to each other so as to attain the desired objective.

More specifically, the system 10 of the present invention is build about a tubular frame 12. The frame is fabricated of a rigid material. The frame has an upper rectangular component 14 and a lower rectangular component 16. They are of a similar size and construction. The rectangular components are disposed in spaced horizontal planes with parallel long sides 18 and 20 and parallel short sides 22 and 24. Vertical posts 26 and 30 are provided to couple the corners of the upper and lower rectangular components. The vertical posts extend downwardly beneath the lower rectangular component. As such, they form extensions 32 and 34 terminating at lower ends 36 and 38 for being supported at the rear end of a boat 40.

The two rearward legs at opposite ends of one long side are provided with an enlarged foot 42. Extending upwardly from the foot is a member 44 with resilient surfaces 46. Such construction is for being removably press-fit into the lower end of an associated extension for coupling therebetween. Formed as a lower extension of the feet are downwardly extending projections 48. Such projections are provided with spaced parallel apertures 50 which extend therethrough. Such apertures are for allowing the coupling thereof with an aperture in the boat with an exposed grommet 52. Such grommet is secured to the boat for coupling purposes.

In a similar manner, the two forward legs 26 at opposite ends of the other long side, the side closer to the rear of the boat, are provided with a similar enlarged foot 62. Such foot has an upwardly extending member 64 with resilient surfaces 66. Such an arrangement is for being removably press-fit into the lower ends of the extensions for coupling therebetween.

Adjustment of the frame to the boat is through a pin 70. Similar pins are provided for each forward leg. The pins are positionable through a preselected aperture of the extensions. The particular selected aperture will vary the elevation of the end of the frame to ensure the proper horizontal positioning thereof in the boat.

Next provided are two intermediate posts 72. Such intermediate posts extend vertically at symmetrical spaced locations along both the forward and rearward edges of the frame. Such posts provide additional stability to the frame.

Additional support for the lower rectangular component is through tubing 76. Such additional tubing is coupled with the lower rectangular component. It extends parallel with the short sides from the front to the rear of the long sides.

The last component of the system is a floor 80. The floor is preferably fabricated of expanded metal material which by its nature forms apertures throughout its surface. The floor is secured around its periphery to the upper surface of the lower rectangular component. A small rectangular opening 82 is centrally disposed through the floor. Such opening is located adjacent to one end thereof, the end closest to the rear of the boat. This allows the positioning of components of an outboard motor 84 thereadjacent. A horizontal support 86 midway between the front and rear long edges of the lower rectangular component is provided for supporting the interior section of the floor adjacent to the forward edge of the small opening.

The present device is a device for carrying equipment in a boat. Fishing gear, hunting supplies, and camping equipment are some of the items that it can carry. It can be used for this purpose whether the boat is in the water or being towed on the highway. The maximum capacity is 750 to 100 pounds of gear.

The present invention is made of one inch tubing and expanded metal. It is essentially a rectangular shelf mounted on four short legs, with a low-slung railing extending around the perimeter of the shelf. The four legs extend up far enough to support the railing at the four corners of the shelf. Also, there are two other support posts secured at even intervals on each of the long sides.

The present invention fits across the full width of the stern of the boat, just in front of the outboard motor. It is secured in place by means of two hitch pins which allow easy installation or removal. The expanded metal shelf is perforated so that any water that happens to get on it will just drain right through the holes instead of accumulating. It can be painted in a variety of matching or contrasting colors suitable for the activities taking place. For those with small boats who need a handy place to carry some of their gear, the present invention has a lot to offer.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A new and improved device for carrying equipment in the rear of a boat adjacent to an outboard motor comprising, in combination:

a tubular frame of a rigid material, the frame having an upper rectangular component and a lower rectangular component, the rectangular components being disposed in spaced horizontal planes with parallel long sides and parallel short sides;

vertical posts coupling the corners of the upper and lower rectangular components and extending downwardly to form extensions terminating at the lower ends for being supported at the rear end of a boat;

the two rearward legs at opposite ends of one long side being provided with an enlarged foot and an upwardly extending member with resilient surfaces for being press fit into the lower ends of the extensions for coupling therebetween and downwardly extending projections with parallel apertures therethrough for coupling with a mating aperture;

the two forward legs at opposite ends of one long side being provided with an enlarged foot and an upwardly extending member with resilient surfaces for being press fit into the lower ends of the extensions for coupling therebetween;

pins positionable through preselected apertures of the extensions;

two intermediate posts extending vertically at symmetrically spaced locations along both the forward and rearward sides of the frame;

additional tubing coupled with the lower rectangular component extending parallel with the short sides from the front to rear long sides; and a floor of expanded metal material secured around its periphery to the upper surface of the lower rectangular component and with a small rectangular opening centrally disposed therethrough adjacent to one long side thereof to allow positioning of components of an outboard motor thereadjacent and with a horizontal support midway between the front and rear long sides of the lower rectangle for supporting the interior section of the floor.

2. A device for carrying equipment in the rear of a boat adjacent to an outboard motor comprising:

a tubular frame of a rigid material, the frame having an upper rectangular component and a lower rectangular component, the rectangular components being disposed in spaced horizontal planes with parallel long sides and parallel short sides;

vertical posts coupling the corners of the upper and lower rectangular components and extending downwardly to form extensions terminating at the lower ends for being supported at the rear end of a boat;

two intermediate posts extending vertically at symmetrically spaced locations along both the forward and rearward edges of the frame;

additional tubing coupled with the lower rectangular component extending parallel with the short sides from the front to rear long sides; and a floor of expanded metal material secured around its periphery to the upper surface of the lower rectangular component and with a small rectangular opening centrally disposed therethrough adjacent to one long side thereof to allow positioning of components of an outboard motor thereadjacent and with a horizontal support midway between the front and rear long sides of the lower rectangle for supporting the interior section of the floor wherein the two forward legs at opposite ends of one long side being provided with an enlarged foot and an upwardly extending member with resilient surfaces for being press fit into the lower ends of the extensions for coupling therebetween.

3. The apparatus as set forth in claim 2 and further including:

pins positionable through preselected apertures of the extentions.

* * * * *